US010145553B1

(12) United States Patent
Richardson et al.

(10) Patent No.: US 10,145,553 B1
(45) Date of Patent: Dec. 4, 2018

(54) ENHANCED LUMINAIRES AND LIGHTING FIXTURE HOUSINGS IMPLEMENTING ENCHANCED PERFORMANCE

(71) Applicant: A.L.P. Lighting & Ceiling Products, Inc, Niles, IL (US)

(72) Inventors: Ronald L. Richardson, Conyers, GA (US); Thanh Minh Vo, Marietta, GA (US); Donald Joseph Gaither, Powder Springs, GA (US)

(73) Assignee: A.L.P. Lighting & Ceiling Products, Inc., Niles, IL (US)

( * ) Notice: Subject to any disclaimer, the term of this patent is extended or adjusted under 35 U.S.C. 154(b) by 0 days.

(21) Appl. No.: 15/711,979

(22) Filed: Sep. 21, 2017

(51) Int. Cl.

| | |
|---|---|
| ***F21V 29/00*** | (2015.01) |
| ***F21V 29/83*** | (2015.01) |
| ***F21V 15/01*** | (2006.01) |
| ***F21V 29/71*** | (2015.01) |
| ***F21V 23/02*** | (2006.01) |
| ***F21S 8/04*** | (2006.01) |
| *F21Y 103/30* | (2016.01) |
| *F21Y 115/10* | (2016.01) |

(52) U.S. Cl.
CPC ..... *F21V 29/83* (2015.01); *F21S 8/04* (2013.01); *F21V 15/01* (2013.01); *F21V 23/026* (2013.01); *F21V 29/71* (2015.01); *F21Y 2103/30* (2016.08); *F21Y 2115/10* (2016.08)

(58) Field of Classification Search
USPC ..... 362/218
See application file for complete search history.

(56) References Cited

U.S. PATENT DOCUMENTS

| | | | | |
|---|---|---|---|---|
| 2008/0285265 | A1* | 11/2008 | Boissevain | F21S 8/086 362/218 |
| 2010/0177514 | A1* | 7/2010 | Liu | F21S 8/04 362/235 |
| 2012/0229025 | A1* | 9/2012 | Edwards, Jr. | H05B 33/0803 315/35 |
| 2013/0088864 | A1* | 4/2013 | Verdes | F21V 29/004 362/235 |
| 2014/0268745 | A1* | 9/2014 | Van de Ven | F21V 15/01 362/235 |
| 2016/0131356 | A1* | 5/2016 | Engberg | F21V 29/76 362/373 |
| 2017/0307204 | A1* | 10/2017 | Cattoni | F21V 29/89 |
| 2018/0087728 | A1* | 3/2018 | Leichner | F21S 2/005 |

* cited by examiner

*Primary Examiner* — Tuyen K Vo
(74) *Attorney, Agent, or Firm* — Joan Pennington

(57) ABSTRACT

A lighting luminaire is provided for implementing enhanced performance for multiple applications. A lighting fixture includes a housing defining a novel heat management system optionally formed by a unitary member or formed by two generally identical housing sections. The housing includes a predefined profile and features for heat transfer including an upper compartment where heat sensitive components are installed and a lower compartment where lighting modules, such as LED modules, are installed. The housing lower compartment includes an upwardly facing lower lens member and predefined features to minimize or prevent heat from traveling upwardly into the upper housing compartment.

19 Claims, 20 Drawing Sheets

ENHANCED LUMINAIRES AND LIGHTING FIXTURE HOUSINGS IMPLEMENTING ENCHANCED PERFORMANCE

FIELD OF THE INVENTION

The present invention relates generally to lighting fixtures and luminaries, and more particularly, relates to new luminaries and enhanced high bay and low bay fixtures housings for implementing enhanced performance for multiple applications and ease of assembly.

DESCRIPTION OF THE RELATED ART

Problems with existing luminaries include difficulty to achieve required performance specifications, particularly with heat sensitive components used. To achieve specified lumens needed excessive heat can be generated. Also higher ambient temperature in facilities with high ceiling heights than at floor level result, for example, due to rising heat.

In the market today there are known high bay fixtures that fail to adequately dissipate heat so that some components can exceed their temperature limits and potentially fail.

Often due to the size and weight of many known fixtures, installation is cumbersome and typically it is not possible for one person to perform the installation alone.

A need exists for new luminaries and enhanced high bay and low bay fixtures for providing enhanced performance for multiple applications. It is desirable to provide new luminaries and enhanced fixtures that enable ease of assembly.

SUMMARY OF THE INVENTION

A principal aspect of the present invention is to provide new luminaries and enhanced lighting fixtures providing enhanced performance for multiple applications. Other important aspects of the present invention are to provide such new luminaries and enhanced fixtures substantially without negative effect and that overcome some disadvantages of prior art arrangements.

In brief, a lighting luminaire is provided for implementing enhanced performance for multiple applications. A lighting fixture includes a housing body defining a novel heat management system. The housing includes a predefined profile and features for enhanced heat transfer including an upper compartment where heat sensitive components are installed and a lower compartment where lighting modules, such as LED modules, are installed. The housing lower compartment includes predefined features for heat transfer and heat extraction and an upwardly facing lower lens member.

In accordance with features of the invention, the housing is formed by two generally identical housing sections.

In accordance with features of the invention, the housing includes the predefined profile and features for heat extraction and transfer. The housing features include exhaust vent and heat blocker openings formed in a sidewall of the housing lower compartment to prevent heat from traveling upwardly into the upper housing cavity. The housing features also include a plurality of louvered heat dissipaters and heat vents to dissipate heat from the lower housing compartment.

In accordance with features of the invention, the housing features optionally include a plurality of heat transfer fins added to an exterior horizontal surface behind the LED lighting modules and on vertical walls of an exhaust chamber with heat slots and louvered heat dissipaters.

In accordance with features of the invention, the housing profile includes a stepped profile with the housing upper compartment having a width substantially less than a width of the housing lower compartment, and an exterior end wall inclined surface connecting the housing upper compartment and the housing lower compartment. The housing upper compartment has an elongated rectangular shape. The housing lower compartment has an exterior elongated upwardly tapered profile and a lower contour of the upwardly facing lower lens member.

In accordance with features of the invention, housing body is formed by sheet metal construction creating a unique two piece body with heat management system.

In accordance with features of the invention, the lower housing wall portions conduct heat emitted from the LED light modules including vent openings and direct heat transfer to the outside ambient air through convection.

In accordance with features of the invention, each of the two generally identical housing sections defining a novel heat management system optionally is a stamped and formed member. Each of the two generally identical housing sections is formed by a sheet metal construction from aluminum and/or steel for adequate strength and rigidity.

In accordance with features of the invention, a unitary housing defining a novel heat management system optionally is formed by extrusion construction. The extrusion housing include fins for heat transfer.

In accordance with features of the invention, an interior gap defines an air flow and wiring channel between the housing upper compartment and the housing lower compartment.

In accordance with features of the invention, the housing has a selected overall width and selected length for selected LED modules enabling use for multiple applications; and said housing having a rigidity, size and weight enabling ease of assembly.

In accordance with features of the invention, an elongated member defines the lower lens member, optionally covers all of the LED lighting modules. The housing optionally includes a plurality of lower lens members, each of the plurality of lower lens members provided with a respective one of a plurality of lighting modules. The lower lens member is formed of an acrylic blended or polycarbonate material.

In accordance with features of the invention, a cover member covers the housing upper compartment and includes an access plate. The housing upper compartment is a driver compartment to contain wiring and driving circuitry coupled to the LED lighting modules.

In accordance with features of the invention, the lighting fixture includes end plates having a shape conforming to an overall housing profile.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
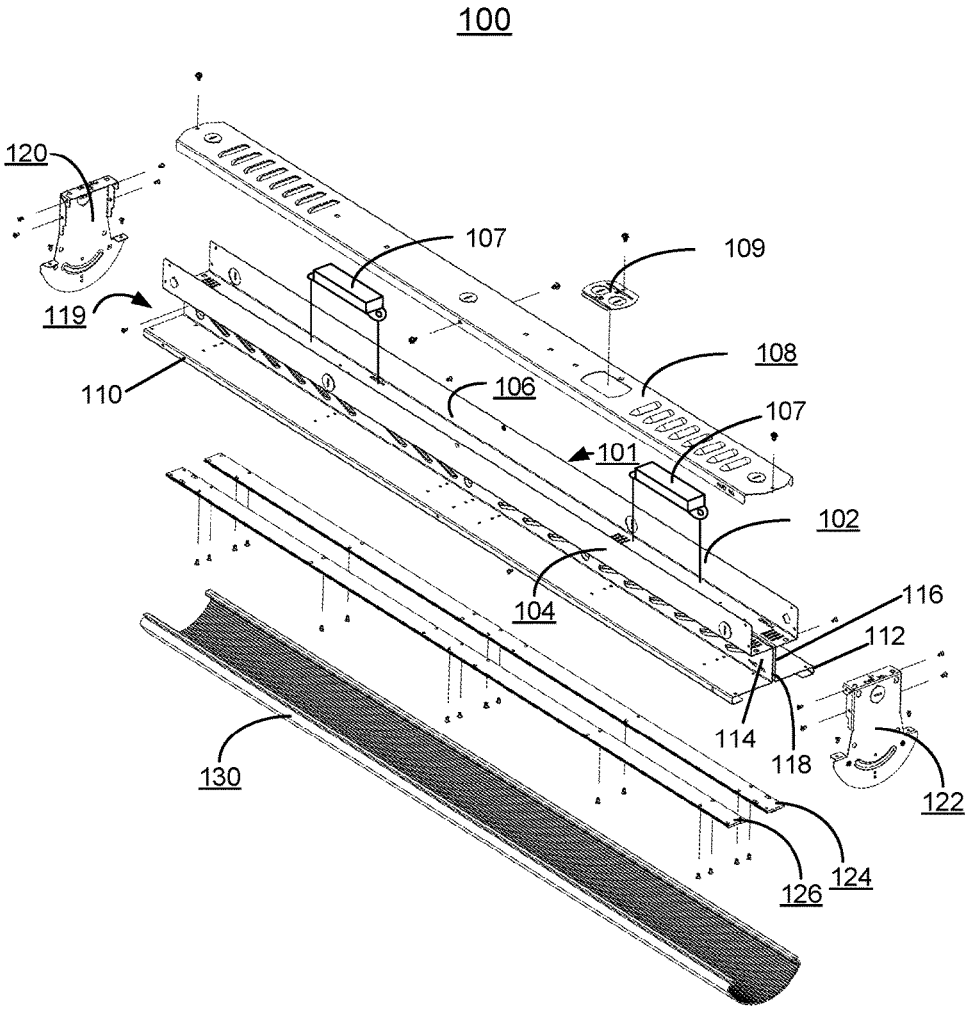
FIG. 1 is an exploded perspective view not to scale illustrating a lighting luminaire including a lighting fixture for implementing enhanced performance for multiple applications in accordance with a preferred embodiment.

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, lighting luminaries and fixtures are provided for implementing enhanced performance for multiple applications. The lighting fixtures includes a housing body defining a novel heat management system. The housing includes a predefined profile and features providing enhanced heat extraction and transfer.

Having reference now to the drawings, in FIGS. 1 and 2-6, there is shown an example lighting luminaire generally designated by the reference character 100 for implementing enhanced performance for multiple applications in accordance with a preferred embodiment The lighting luminaire 100 includes a housing 101 including a predefined profile and features providing enhanced heat transfer in accordance with a preferred embodiment.

The housing 101 is formed by two generally identical housing sections 102, 104 providing novel heat management. An upper cavity or housing upper compartment 106 is defined by the housing sections 102, 104 and a cover 108 with an access plate 109 provided with the cover 108. The housing upper compartment 106 has an elongated rectangular shape. The housing upper compartment 106 provides a driver compartment where heat sensitive components are installed. A pair of example driving modules 107 are received in the housing upper compartment 106, as shown.

The two generally identical housing sections 102, 104 define a novel heat management system. Each of the two generally identical housing sections 102, 104 advantageously is formed by a sheet metal construction from aluminum and/or steel for adequate strength and rigidity.

The housing 101 is a generally small and light weight, for example, made from aluminum and/or steel, and enabling easy installation, for example, by one person. A respective lower housing flanged base member 110, 112 of the housing sections 102, 104 is generally flat. A respective sidewall 114, 116 define a gap 118 between housing sections 102, 104 in a housing lower compartment 119. The gap 118, best seen in FIGS. 2 and 3, extends between the housing body sections 102, 104 defining an air flow and wiring channel between the housing upper compartment 106 and the housing lower compartment 119.

In accordance with features of the invention, the housing 101 advantageously is formed by sheet metal construction creating a unique two piece body 102, 104 providing enhanced heat management. The housing sections 102, 104 defining the novel heat management system optionally is a stamped and formed member.

A pair of end plates 120, 122 complete the housing assembly having a profile corresponding to the housing profile. As shown, a pair of lighting modules or such as LED modules 126, 128, are installed within the lower compartment 119.

A lower lens member 130 is an upwardly open lower lens member mounted to lower ledge members 110, 112 of the housing lower compartment 119. The lower lens member 130 is formed, for example, of an acrylic blended or polycarbonate material. The lower lens member 102 receives a plurality (two shown) of lighting modules 124, 126 or LED modules 124, 126.

Figure 2:
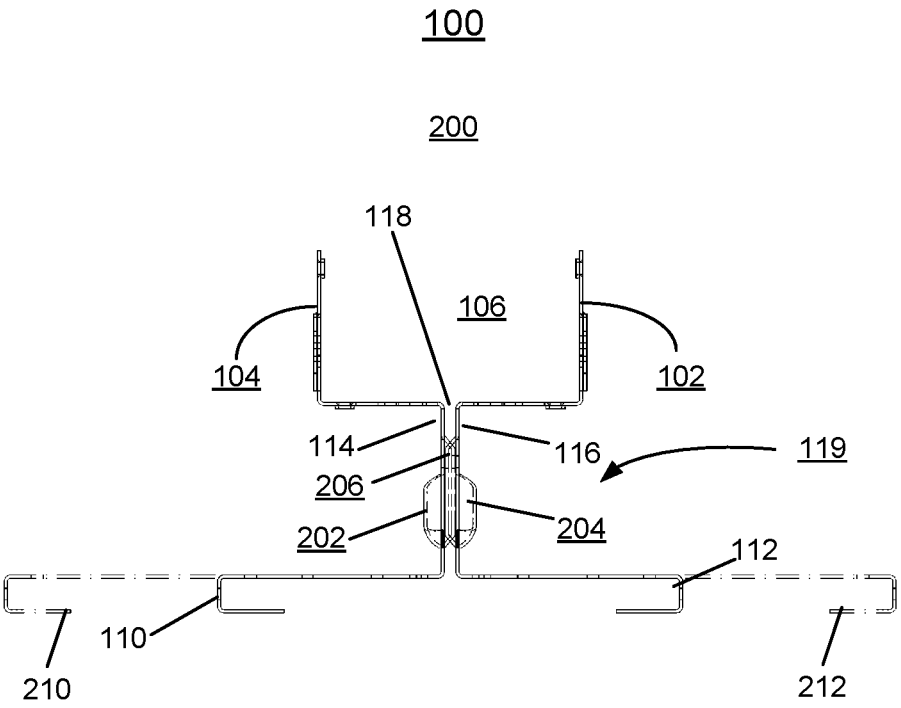
FIGS. 2-6 illustrate features and details of the lighting fixture of FIG. 1 in accordance with a preferred embodiment.

Referring now to FIG. 2, a sectional detail generally designated by the reference character 200 of the lighting luminaire 100 illustrates a plurality of louvered heat dissipaters and heat vents 202, 204 and exhaust vent and heat blocker openings 206 formed in the sidewalls 114, 116, respectively to dissipate heat from the lower housing compartment 119, and to minimize or substantially prevent heat from traveling upwardly into the upper housing cavity. Optional wider ledge members 210, 212 of the housing lower compartment 119 is shown in dotted lines. With the wider ledge members 210, 212, additional LED lighting modules, such as LED modules 126, 128 optionally can be installed within the lower compartment 119, for example for applications requiring higher output lumens.

Figure 3:
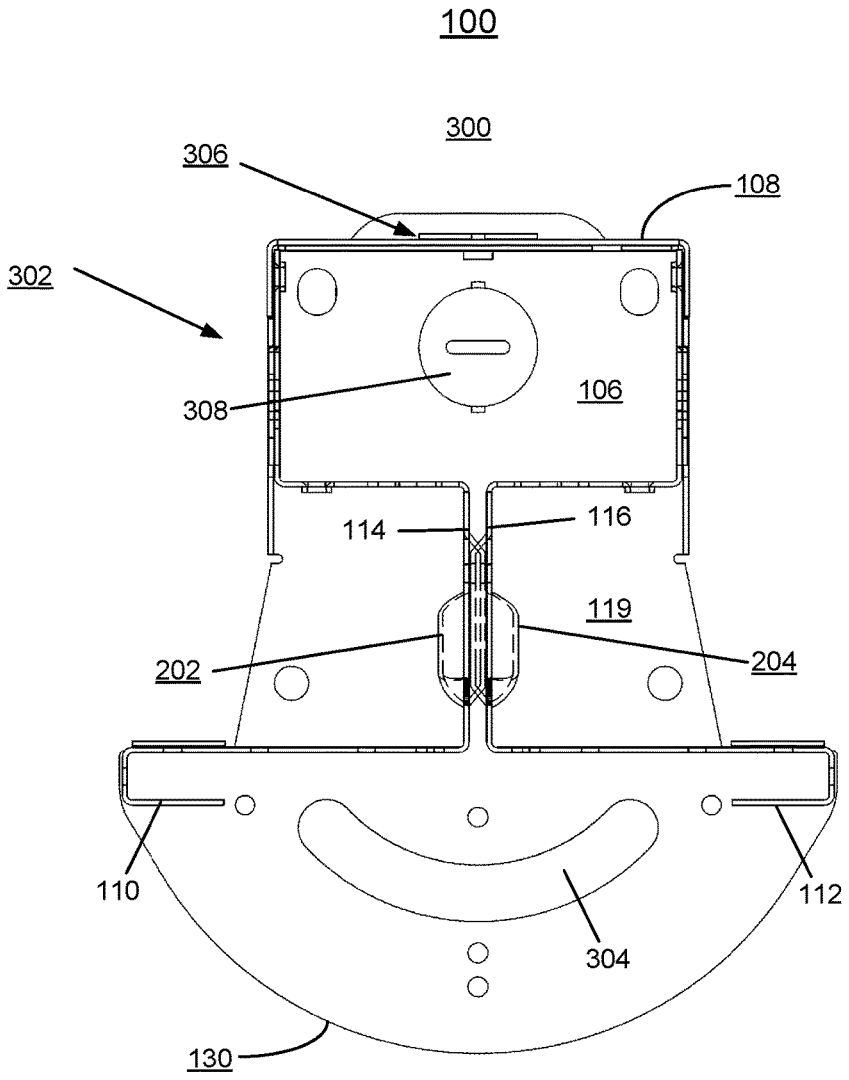

Referring now to FIG. 3, an end view generally designated by the reference character 300 of the lighting luminaire 100 illustrates a housing profile generally designated by the reference character 302. The housing profile 302 includes a stepped profile with the housing upper compartment 106 having a width substantially less than a width of the housing lower compartment 119, and an end wall with exterior upwardly tapered profile connects the housing upper compartment 106 and the housing lower compartment 119. An example vent opening 304 in the housing lower compartment 119 and an example mounting hardware 306 are shown. An example mounting fastener 308 is shown in the housing section 104.

Figure 4:
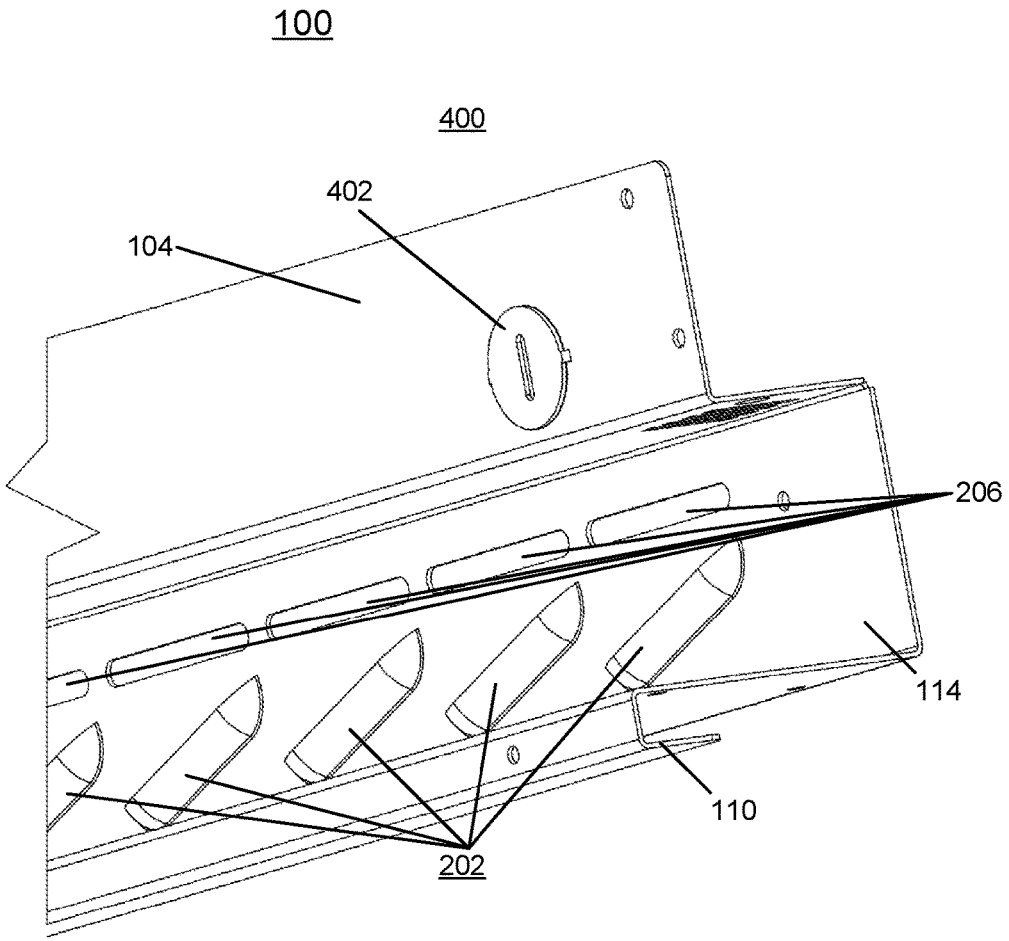
Figure 5:
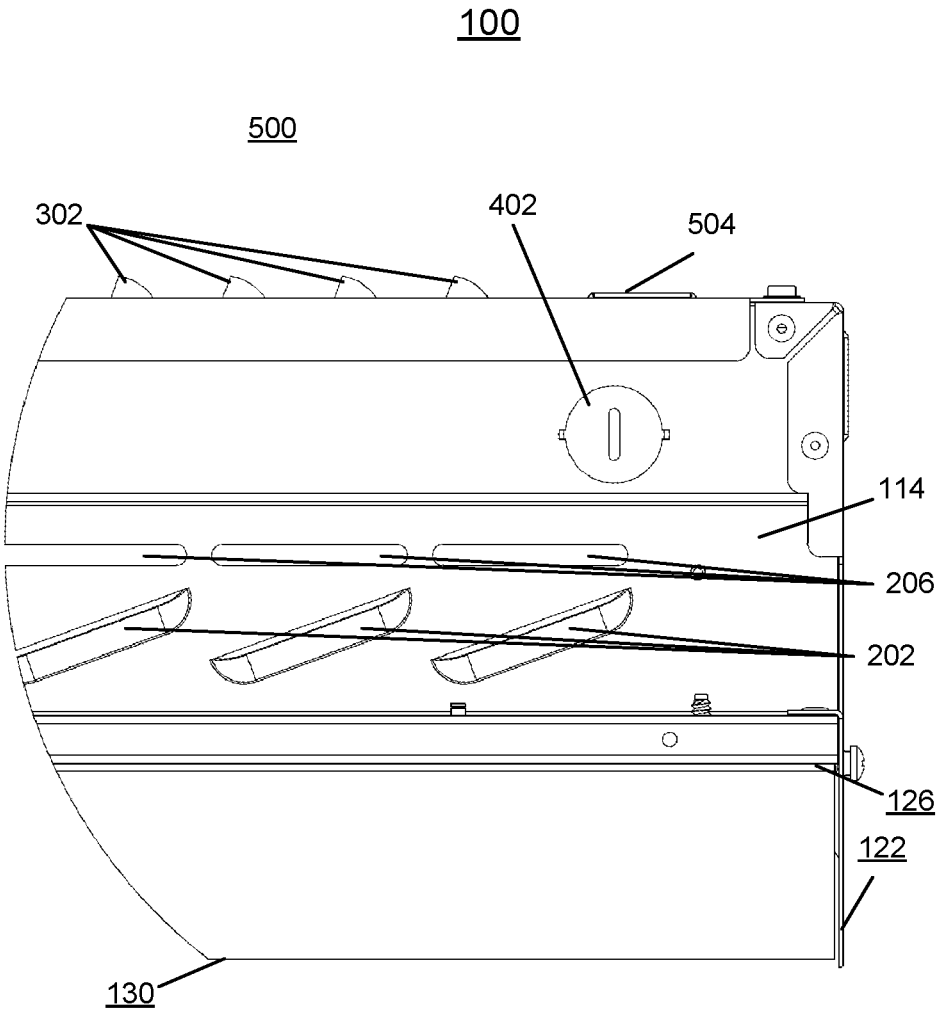

Referring now to FIGS. 4 and 5, a respective sectional detail generally designated by the reference character 400, 500 of the lighting luminaire 100 illustrates the plurality of louvered heat dissipaters and heat vents 202 and exhaust vent and heat blocker openings 206 formed in the sidewall 114. An example mounting fastener 402 is shown in the housing section 104. In FIG. 5, the end plate 122 is shown with the LED modules 126 and lens 130.

Figure 6:
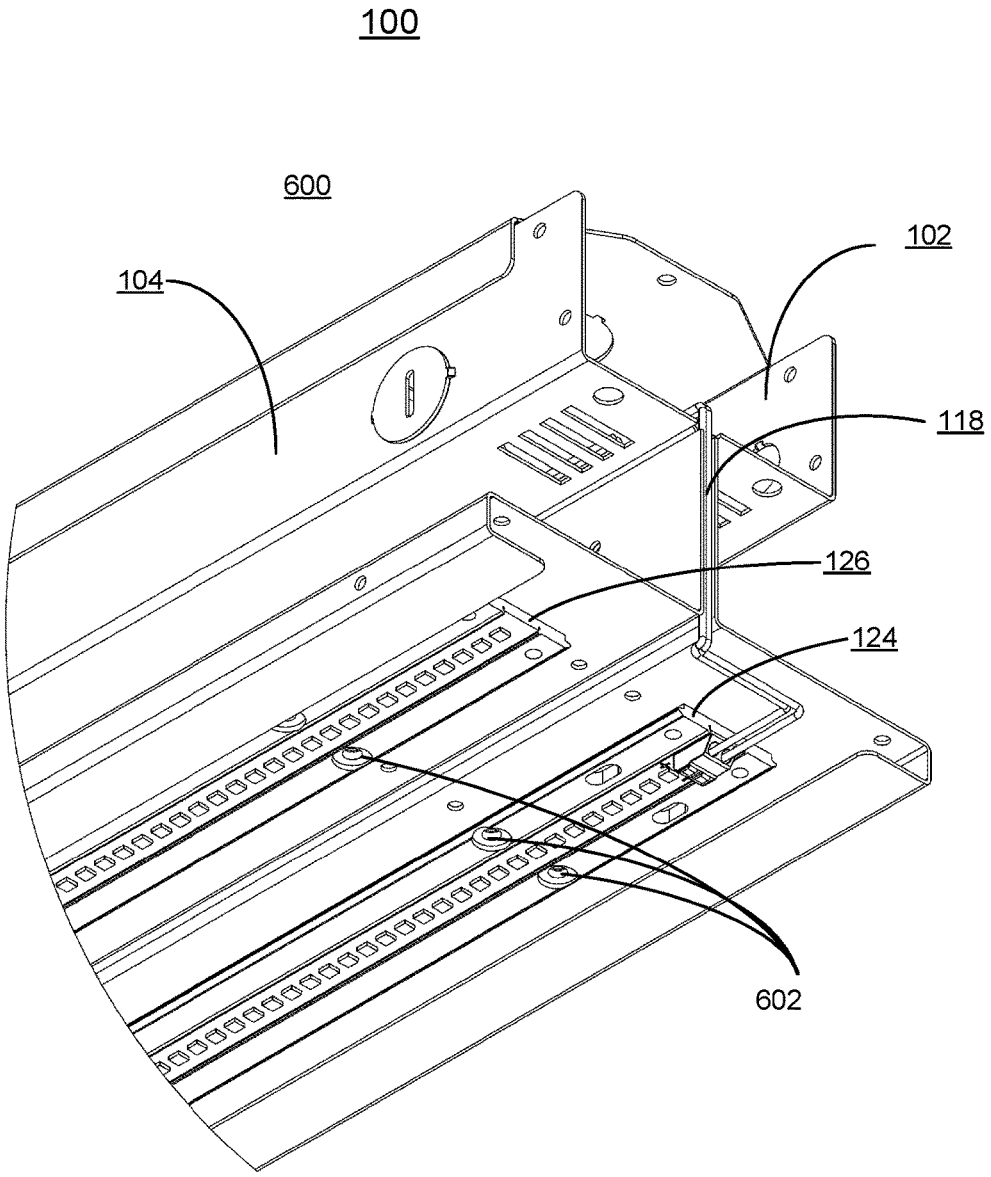

Referring now to FIG. 6, a perspective detail generally designated by the reference character 600 of the lighting luminaire 100 illustrates the pair of LED lighting modules 124, 126 installed within the lower compartment 119 and the gap 118 between the housing body sections 102, 104 defining the air flow and wiring channel between the housing upper compartment 106 and the housing lower compartment 119. Example mounting fasteners 602 are shown LED lighting modules 124, 126.

Referring now to FIGS. 7 and 8-14, there is shown another example lighting luminaire generally designated by the reference character 700 for implementing enhanced performance for multiple applications in accordance with a preferred embodiment. The lighting luminaire 700 advantageously is formed by extrusion construction and includes a similar housing profile as the sheet metal stamped and formed lighting luminaire 100, The lighting luminaire 700 includes a housing 701 including a predefined profile and heat transfer fins providing enhanced heat management in accordance with a preferred embodiment.

The housing 701 similarly is formed as a unitary member formed by extrusion construction with opposing housing sections 702, 704 providing enhanced heat management. A housing upper compartment 706 is defined by the opposing housing sections 702, 704 and a cover 708 with an access plate 709 provided with the cover 708. The housing upper compartment 706 has an elongated rectangular shape. The housing upper compartment 706 provides a driver compartment where heat sensitive components are installed. A pair of example driving modules 707 are received in the housing upper compartment 706, as shown.

In accordance with features of the invention, the housing 701 formed by extrusion of a selected material providing needed strength and rigidity. The housing 701 is a generally small and light weight, formed, for example, by aluminum extrusion and enabling easy installation, for example, by one person. It should be understood that other materials can be used, such as polymer and composite polymer materials, for extrusion and/or co-extrusion.

Each respective lower housing flanged base portion 710, 712 of the housing sections 702, 704 of the unitary housing 701 is generally flat and includes a plurality of fins 721. A respective interior sidewall 714, 716 of the housing sections 702, 704 defines a gap 718 providing an air flow and wiring channel between the housing upper compartment 706 and a housing lower compartment 719. Gap 718 defines an exhaust chamber including a plurality of fins 721.

A pair of end plates 720, 722 complete the housing assembly including a profile corresponding to the housing profile of housing 701. As shown, a pair of lighting modules or such as LED modules 724, 726, are installed within the lower compartment 719.

A lower lens member 730 is an upwardly open lower lens member mounted to lower ledge portions 710, 712 of the housing lower compartment 719. The lower lens member 730 is formed, for example, of an acrylic blended or polycarbonate material. The lower lens member 730 receives a plurality (two shown) of lighting or LED modules 724, 726.

Figure 8:
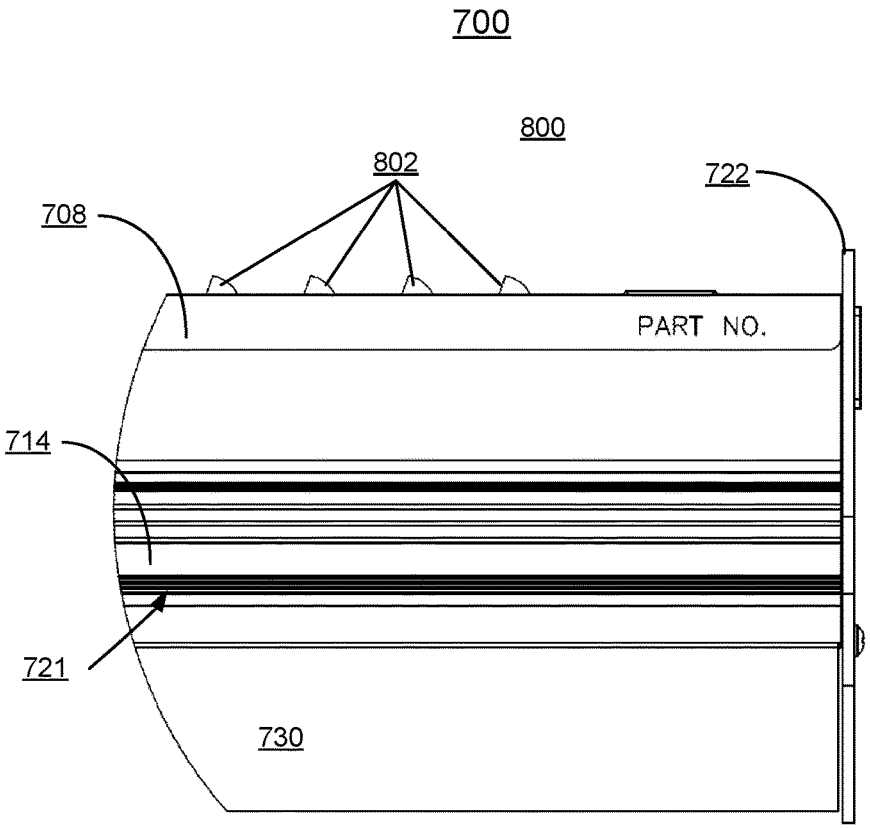
FIGS. 8-14 illustrate features and details of the lighting fixture of FIG. 7 in accordance with a preferred embodiment.

Referring now to FIG. 8, a sectional detail generally designated by the reference character 800 of the lighting luminaire 700 illustrates the plurality of fins 721 formed in the sidewall 714 and louvers 802 formed in the cover plate 708.

Figure 9:
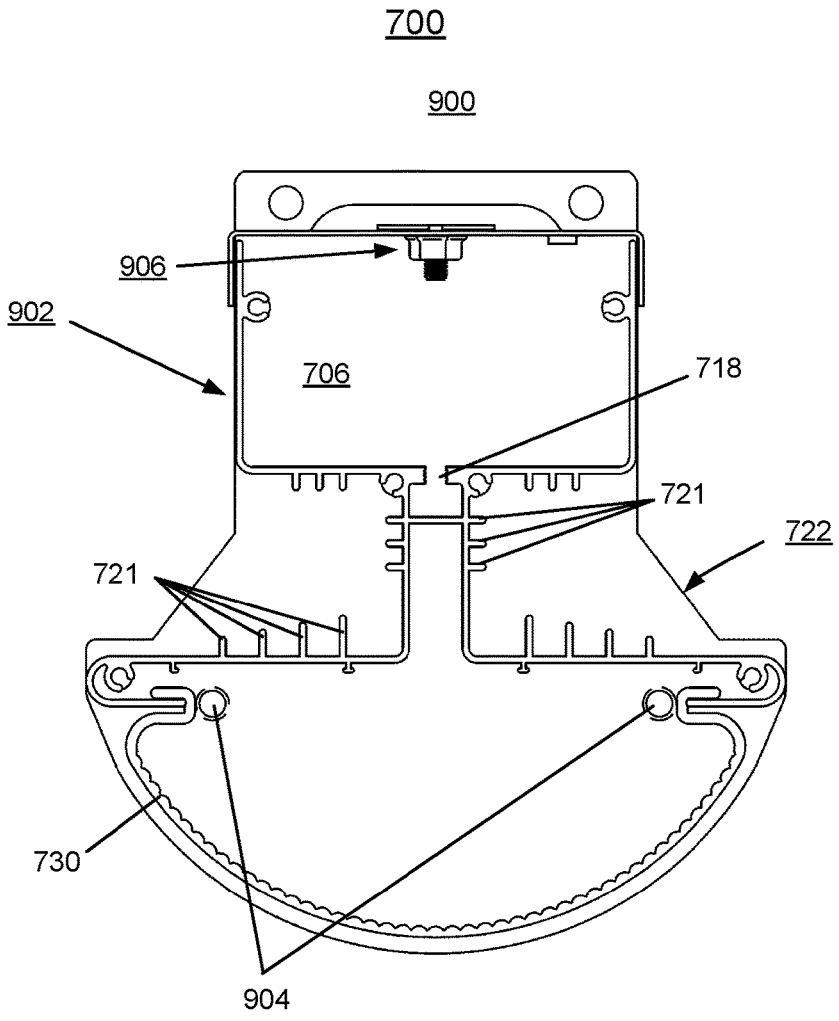

Referring now to FIG. 9, an end view generally designated by the reference character 900 of the lighting luminaire 700 illustrates a housing profile generally designated by the reference character 902. The housing profile 902 includes a stepped profile with the housing upper compartment 706 having a width substantially less than a width of the housing lower compartment 719, and illustrates the end wall 722 with exterior upwardly tapered profile connecting the housing upper compartment 706 and the housing lower compartment 719. Example fastener receiving openings 904 are shown for receiving fasteners (not shown) to secure the lens 730. Example mounting hardware 906 are shown for the housing 701.

Figure 10:
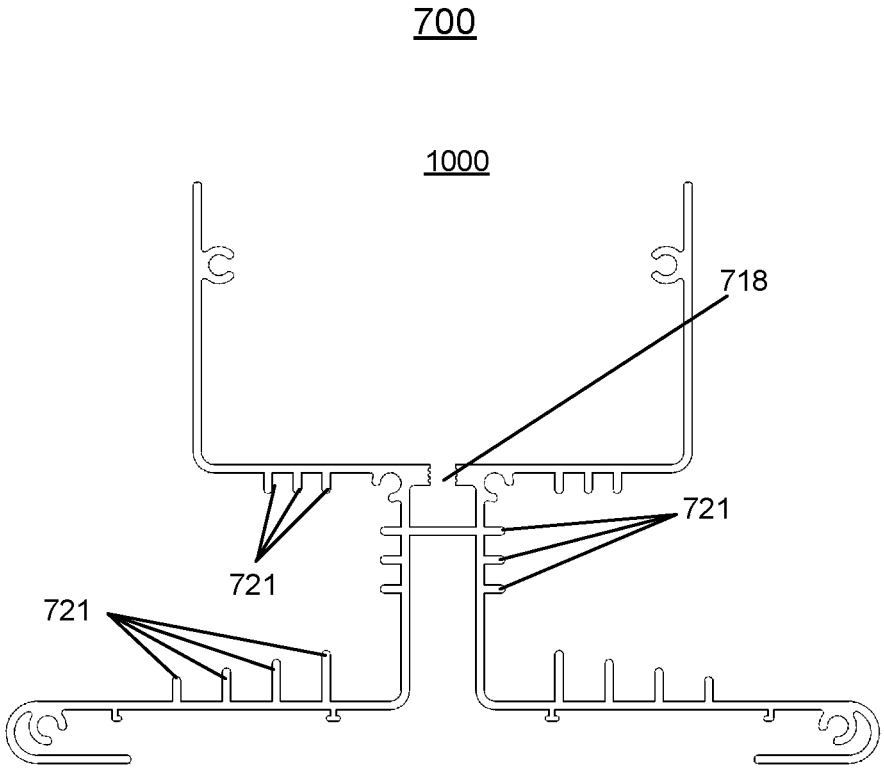
Figure 11:
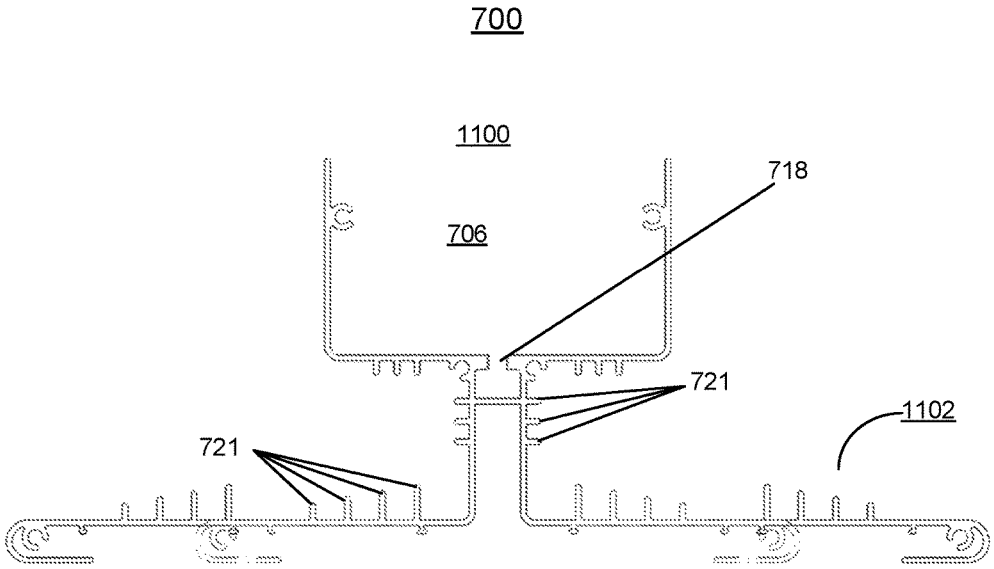

Referring now to FIGS. 10 and 11, a respective sectional detail generally designated by the reference characters 1000, 1100 of the lighting luminaire 700 illustrates a plurality of fins 721 to dissipate heat from the lower housing compartment 719, and to prevent heat from traveling upwardly into the upper housing compartment 706. Optional wider ledge portions 1102 of the housing lower compartment 119 are shown in FIG. 11. With the wider ledge members 1102, additional LED lighting modules, such as LED modules 724, 726 can be installed within the lower compartment 119, for example for applications requiring higher output lumens.

Figure 12:
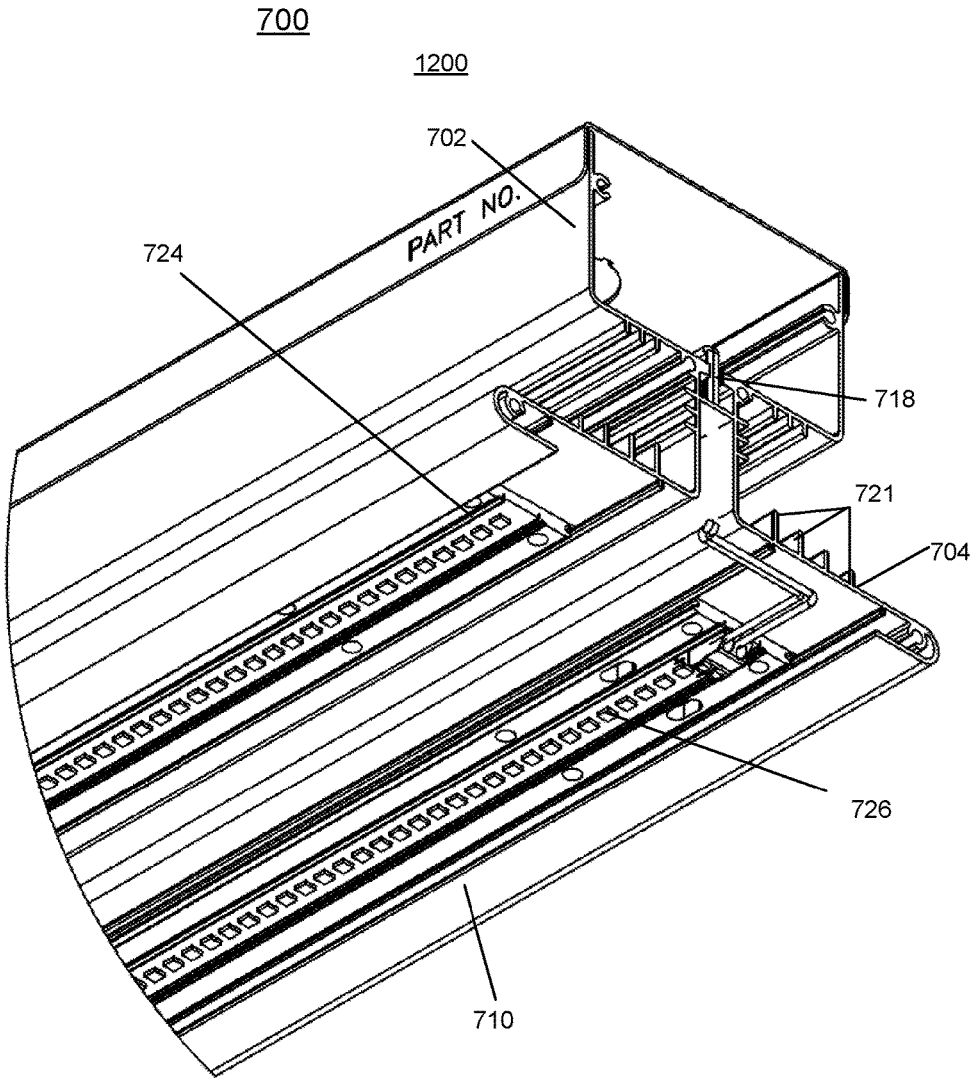

Referring now to FIG. 12, a perspective detail generally designated by the reference character 1200 of the lighting luminaire 700 illustrates the pair of LED lighting modules 724, 726 installed on lower housing flanged base portions of 710, 712 of the lower compartment and the gap 718 between the housing body sections 702, 704 defining the air flow and wiring channel 718 between the housing upper compartment 706 and the housing lower compartment 719.

Figure 13:
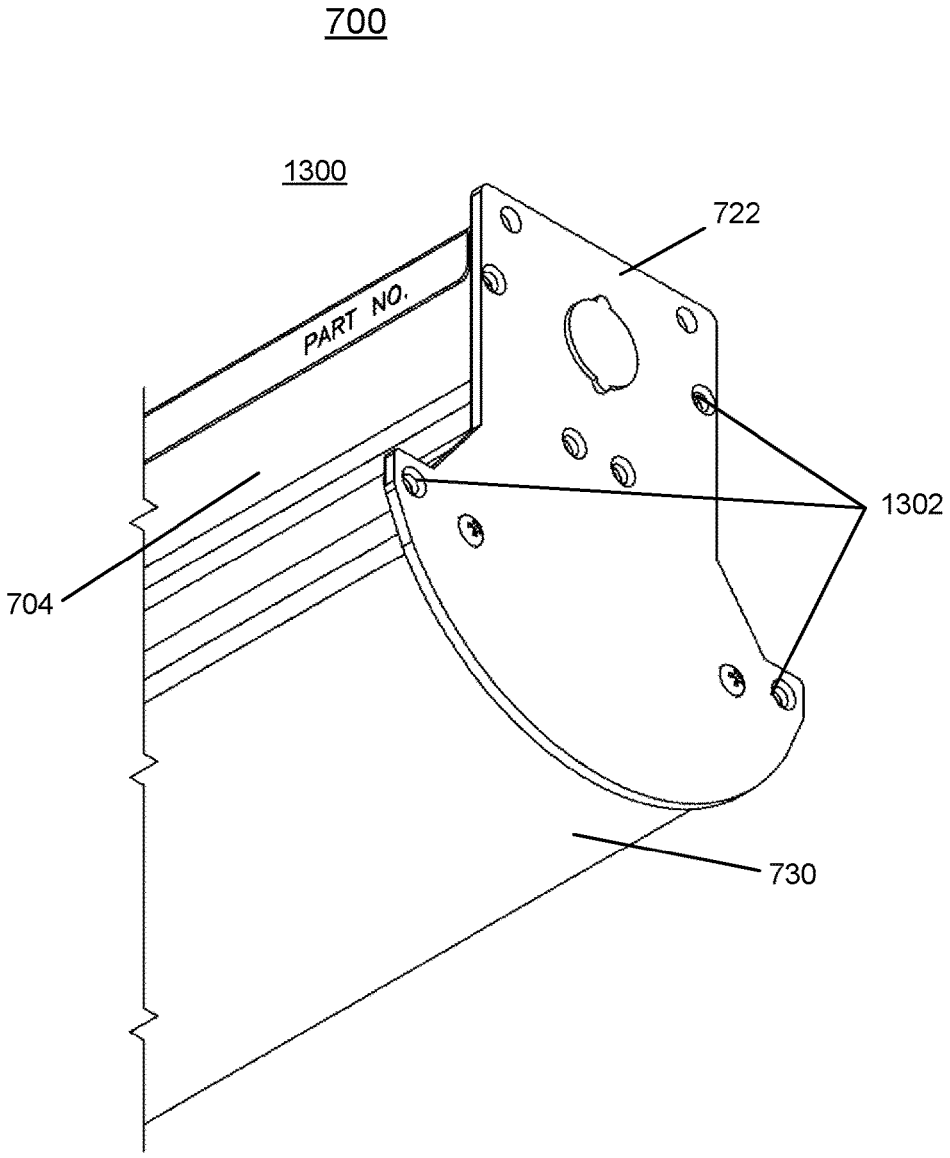

Referring now to FIG. 13, a perspective detail generally designated by the reference character 1300 of the lighting luminaire 700 illustrates the end plate 722 with lens member 730 and housing section 704. Example fastener receiving openings 1302 are shown for receiving fasteners (not shown) to secure the end plate 722 with the unitary housing 701 of the lighting luminaire 700.

Figure 14:
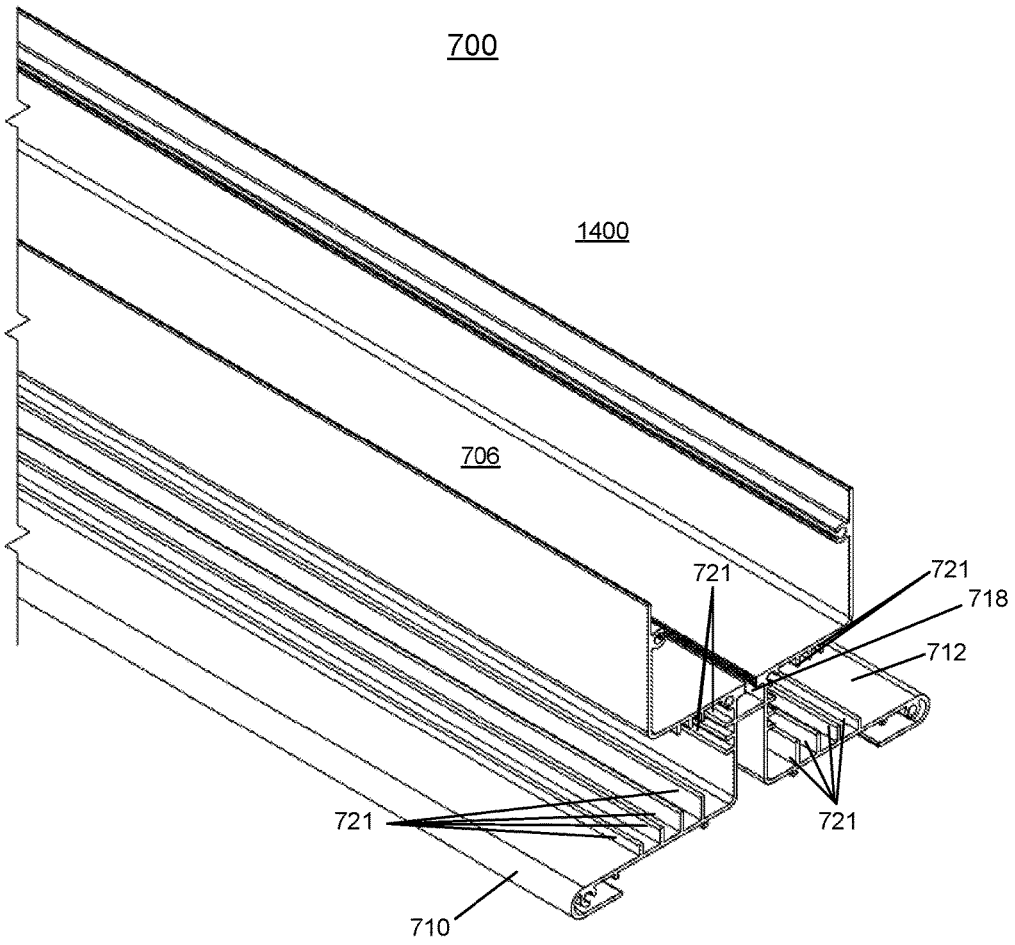

Referring now to FIG. 14, a perspective detail generally designated by the reference character 1400 of the lighting luminaire 700 illustrates a plurality of example fins 721 formed on the lower housing flanged base member 710, 712 the side walls 714, 716 and formed on lower surfaces of the housing upper compartment 706.

Figure 7:
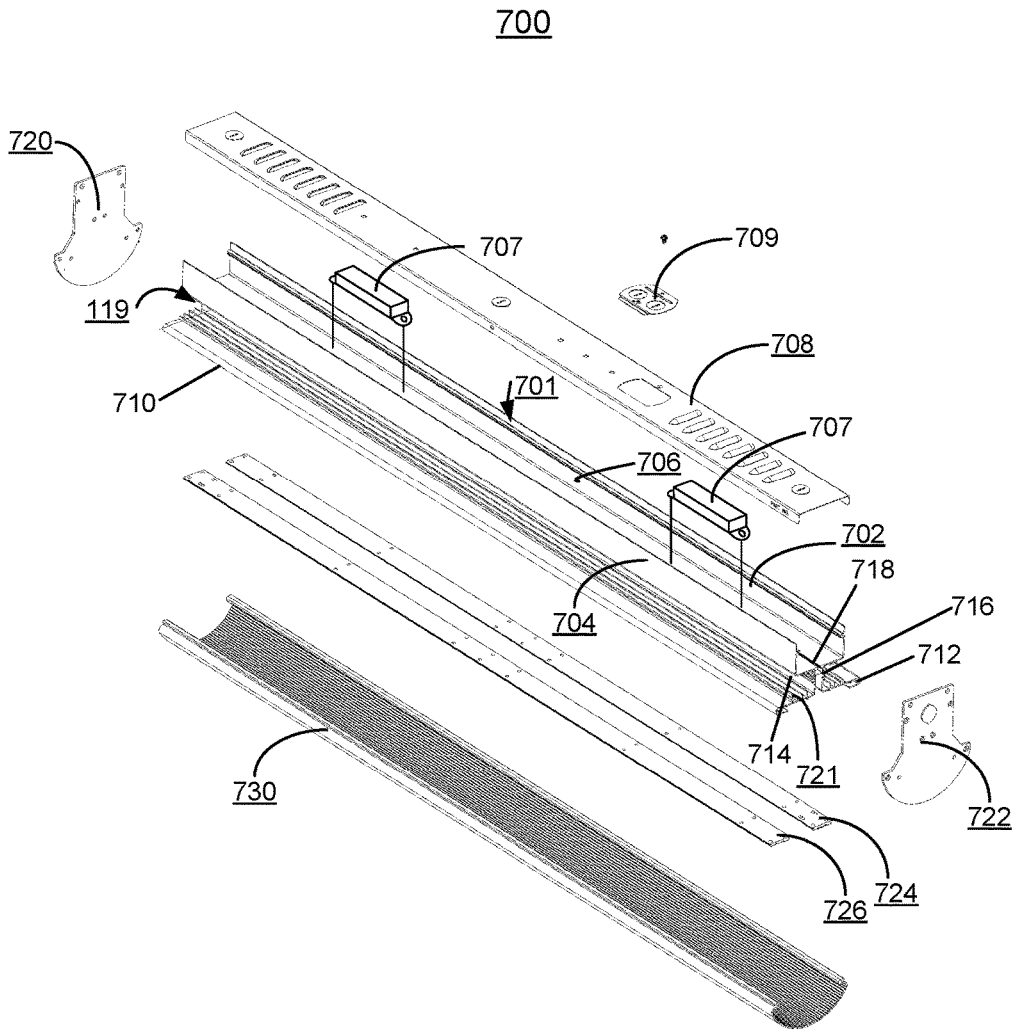
FIG. 7 is an exploded perspective view not to scale illustrating another lighting luminaire including another lighting fixture for implementing enhanced performance for multiple applications in accordance with a preferred embodiment.

Referring now to FIGS. 15-20, there are shown alternative lens arrangements of the lighting luminaries 100, 700 of FIG. 1 and FIG. 7 in accordance with preferred embodiments. In FIGS. 15-20, while features of lighting luminaire 700 are shown, it should be understood that each of the illustrated alternative lens arrangements advantageously is used with the lighting luminaire 100 of FIG. 1.

Figure 15:
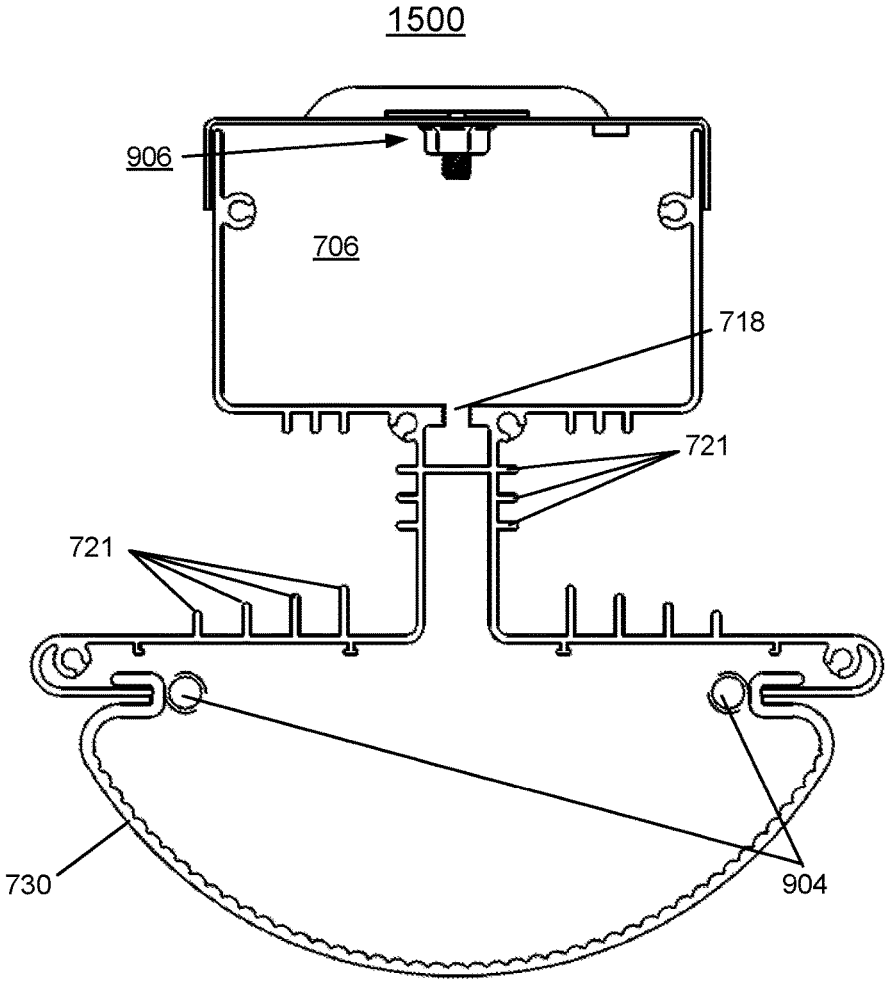
FIGS. 15-20 illustrate alternative lens arrangements of the lighting fixtures of FIG. 1 and FIG. 7 in accordance with preferred embodiments.

In FIG. 15, a first lens arrangement generally designated by the reference character 1500 includes a single lens 730, as shown with lighting luminaries 100, 700.

Figure 16:
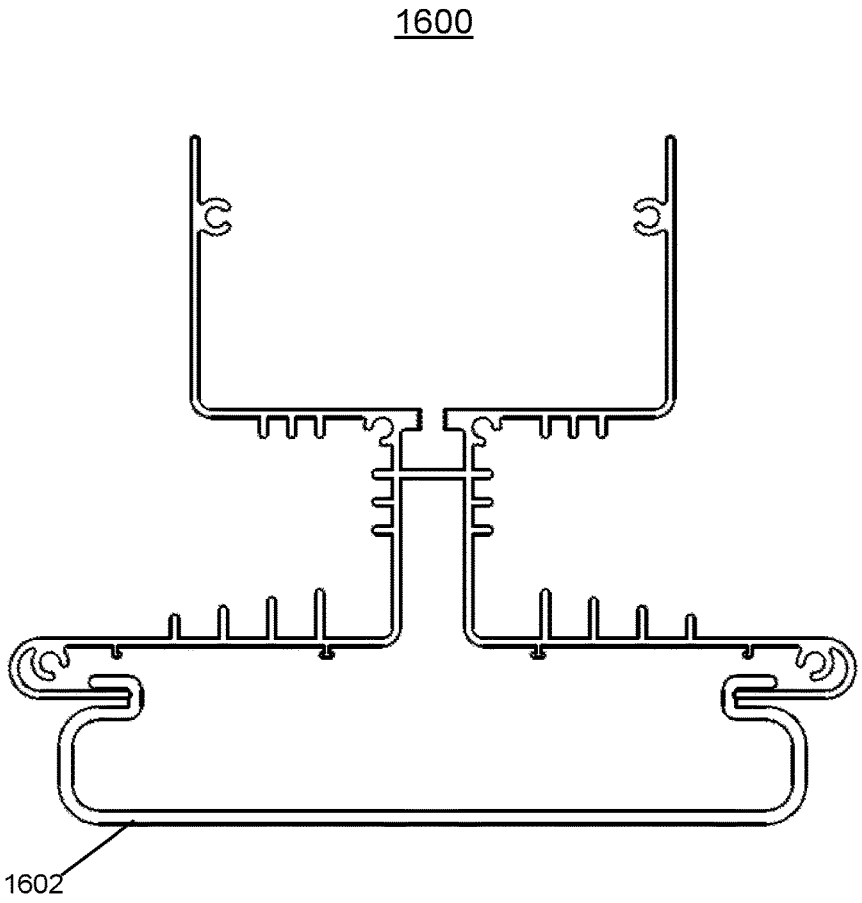

In FIG. 16, a second lens arrangement generally designated by the reference character 1600 includes a single lens 1602 for use with lighting luminaries 100, 700. The single lens 1602 includes a generally rectangular configuration with a flat lower surface, as shown.

Figure 17:
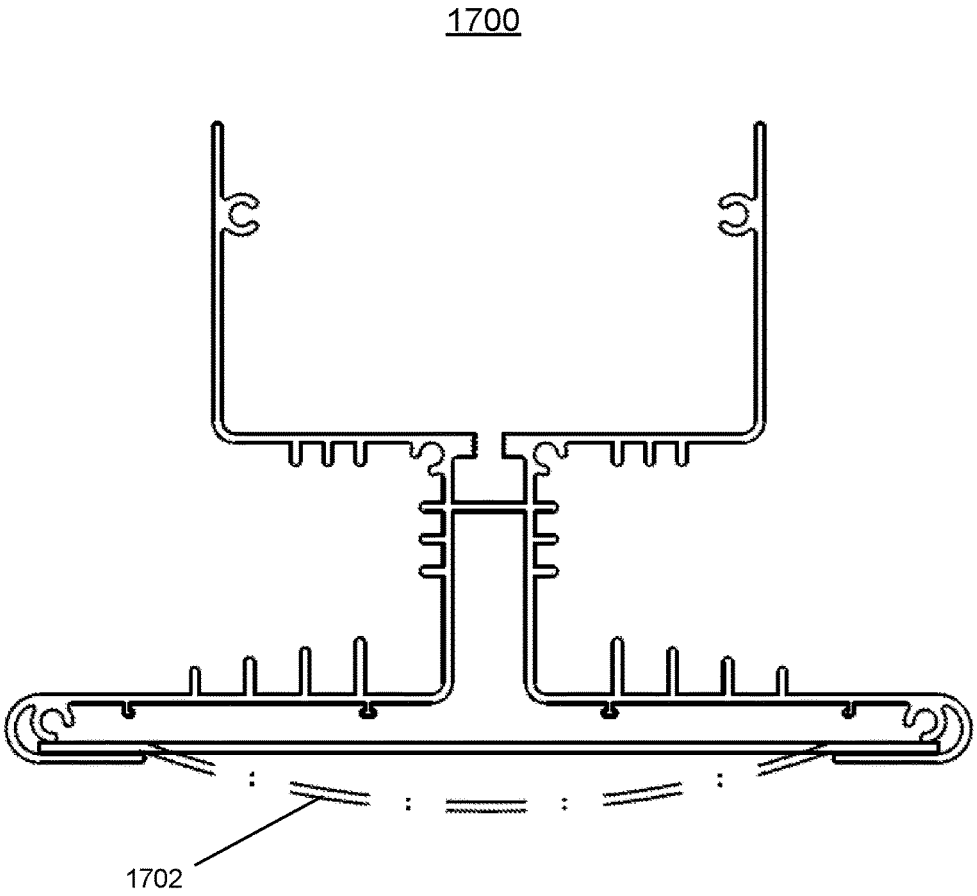

In FIG. 17, a third lens arrangement generally designated by the reference character 1700 includes a single lens 1702 for use with lighting luminaries 100, 700. Single lens 1702 includes a curved lower surface, smaller than the single lens 730.

Figure 18:
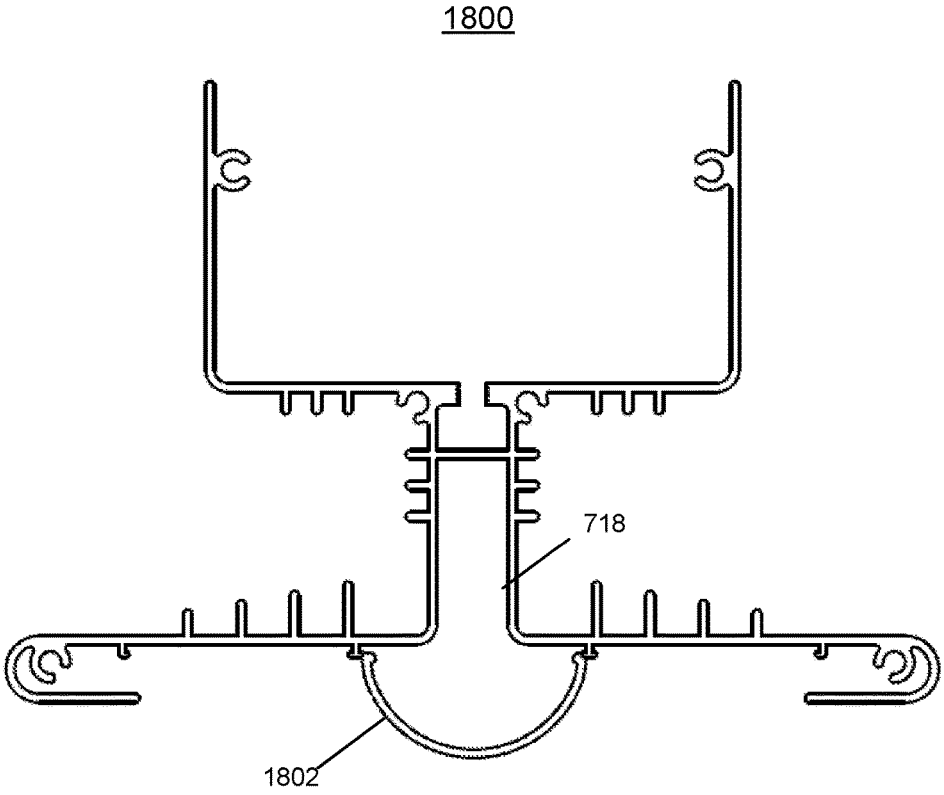

In FIG. 18, a fourth lens arrangement generally designated by the reference character 1800 includes a single lens 1802 for use with lighting luminaries 100, 700. Single lens 1802 extends across the gap 718, having a much smaller width than the single lens 730, for example, for low lumens application.

Figure 19:
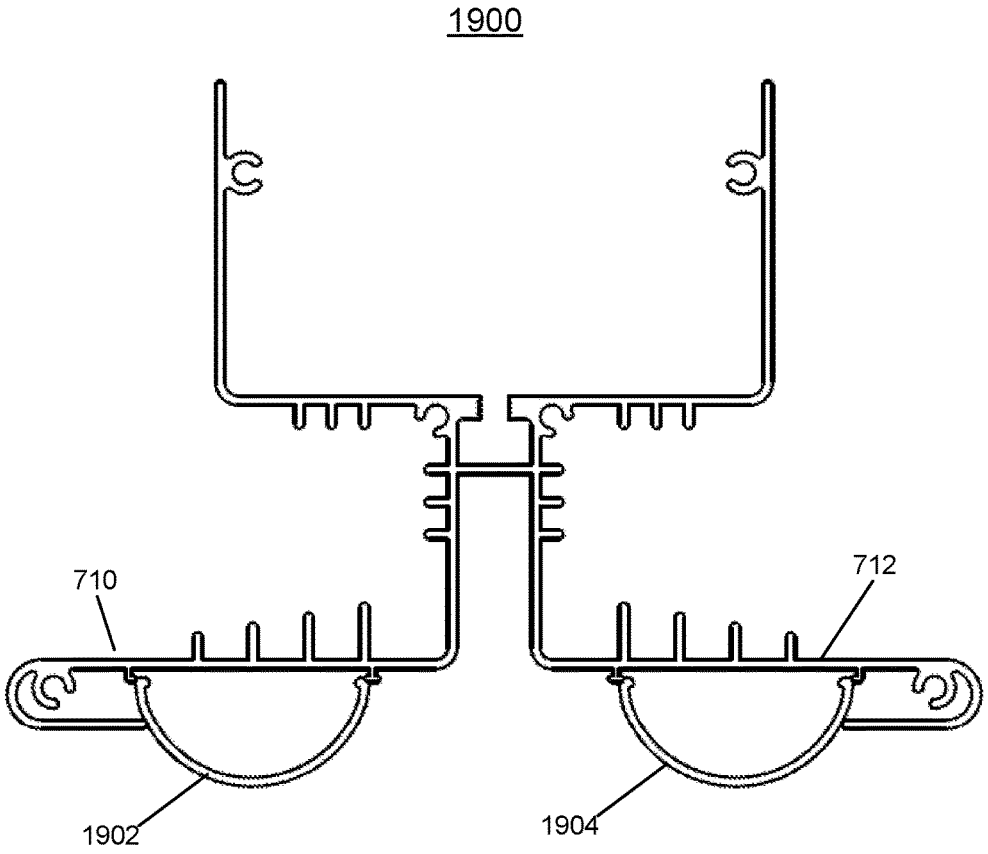

In FIG. 19, a fifth lens arrangement generally designated by the reference character 1900 includes a pair of lens 1902, 1904 for use with lighting luminaries 100, 700. The two lens

1902, 1902 extends across a portion of the lower members 710, 712, each having a much smaller width and height than the single lens 730.

Figure 20:
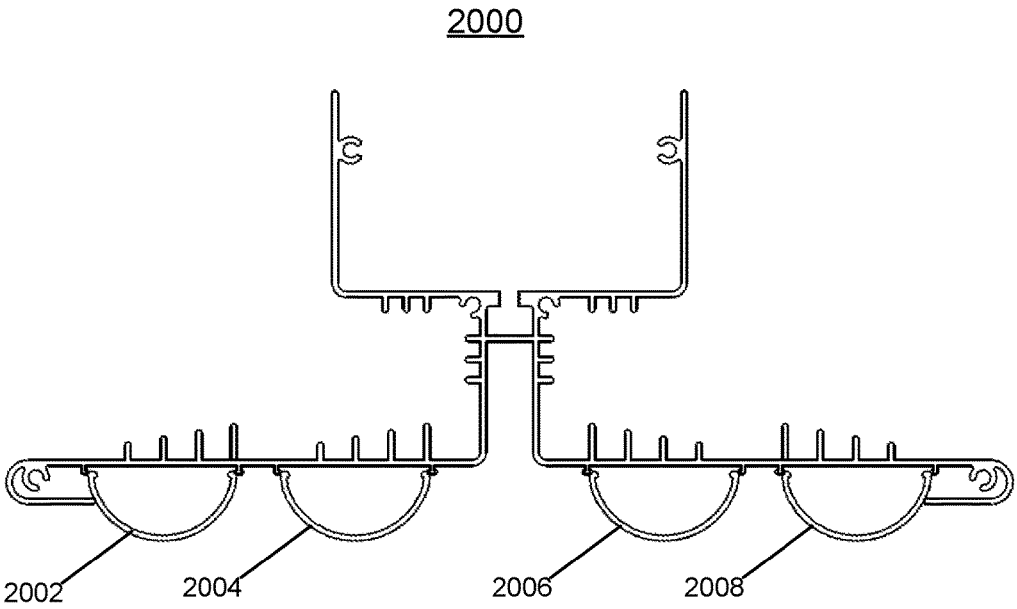

In FIG. 20, a sixth lens arrangement generally designated by the reference character 2000 includes two pairs of lens 2002, 2004 and 2006, 2008 for use with lighting luminaries 100, 700. The pairs of lens 2002, 2004 and 2006, 2008 extends across a portion of the lower members 710, 712, each having a much smaller width than the single lens 730.

It should be understood that the lighting luminaries 100, 700 are not limited to the illustrated arrangements, for example, a cover member could be provided together with the respective gap 118, 718 for covering the respective gaps. Other changes could be made without departing from features of the invention.

In summary, the lighting luminaire 100, 700 of the invention are designed to implement enhanced performance for multiple applications. The fixture housings includes a predefined profile and features for enhanced heat management. The lighting luminaire 100, 700 of the invention overcome disadvantages of many known commercially available fixtures, enabling various sizes, for example, including various combinations length and width, for selected output lumens together with ease of installation.

While the present invention has been described with reference to the details of the embodiments of the invention shown in the drawing, these details are not intended to limit the scope of the invention as claimed in the appended claims.

What is claimed is:

1. A lighting luminaire for implementing enhanced performance for multiple applications comprising:

a lighting fixture includes a housing defining a novel heat management housing;

said housing includes a predefined profile and features for heat transfer including a housing upper compartment receiving selected components and a housing lower compartment receiving lighting modules;

said housing lower compartment includes predefined features providing enhanced heat transfer, and preventing heat from traveling upwardly into said upper housing compartment and receives an upwardly facing lower lens member;

said housing lower compartment includes an elongated interior gap generally centrally located defining an air flow and wiring channel between said housing upper compartment and said housing lower compartment.

2. The lighting luminaire as recited in claim 1 wherein said predefined features of said housing lower compartment include exhaust vent and heat blocker openings formed in a sidewall of the housing lower compartment to prevent heat from traveling upwardly into the upper housing cavity.

3. The lighting luminaire as recited in claim 1 wherein said predefined features for heat transfer of said housing lower compartment include a plurality of louvered heat dissipaters and heat vents to dissipate heat from the lower housing compartment.

4. The lighting luminaire as recited in claim 1 includes said housing formed by two generally identical housing sections wherein said housing sections are formed by aluminum extrusion and sheet metal construction.

5. The lighting luminaire as recited in claim 1 includes said housing formed by a unitary member and wherein said predefined features of said housing includes a plurality of heat transfer fins added to selected surfaces of said housing lower compartment and said housing upper compartment.

6. The lighting luminaire as recited in claim 5 wherein said predefined features of said housing includes a plurality of heat transfer fins added on vertical walls of an exhaust chamber.

7. The lighting luminaire as recited in claim 1 wherein said lighting modules include Light Emitting Diode (LED) modules.

8. The lighting luminaire as recited in claim 1 wherein said housing profile includes a stepped profile with the housing upper compartment having a width substantially less than a width of the housing lower compartment, and an exterior end plate with an exterior upwardly tapered profile connecting the housing upper compartment and the housing lower compartment.

9. The lighting luminaire as recited in claim 8 includes said housing upper compartment having an exterior elongated rectangular shape and said housing lower compartment having an exterior elongated upwardly tapered profile.

10. The lighting luminaire as recited in claim 1 includes said housing having a selected overall width and selected length for multiple applications; and said housing having a size and weight enabling ease of assembly.

11. The lighting luminaire as recited in claim 1 wherein said housing body is formed by sheet metal construction.

12. The lighting luminaire as recited in claim 1 includes a pair of housing sections, and wherein each of said pair of housing sections is formed of aluminum sheet metal.

13. The lighting luminaire as recited in claim 1 includes a pair of housing sections, and wherein each of said pair of housing sections is formed of steel sheet metal.

14. The lighting luminaire as recited in claim 1 includes a pair of housing sections, and wherein each of said pair of housing sections is formed of aluminum.

15. The lighting luminaire as recited in claim 1 wherein said housing is formed by an extrusion construction.

16. The lighting luminaire as recited in claim 15 wherein said extrusion housing include a plurality fins providing heat transfer.

17. The lighting luminaire as recited in claim 1 includes an elongated member defining said lower lens member covering at least one of the LED lighting modules.

18. A lighting fixture for implementing enhanced performance for multiple applications comprising:

a housing body formed by two generally identical housing sections defining a novel heat management housing; and said housing sections formed by a sheet metal construction from a selected one of aluminum and steel, said housing includes a predefined profile and features providing enhanced heat transfer including a housing upper compartment receiving driver components and a housing lower compartment for receiving Light Emitting Diode (LED) lighting modules, said predefined profile including a stepped profile with said housing upper compartment having a width substantially less than a width of said housing lower compartment, and an end wall with exterior upwardly tapered profile connects the housing upper compartment and the housing lower compartment; and said housing lower compartment including predefined features providing enhanced heat transfer and receiving an upwardly facing lower lens member; and said housing including a gap extending between said housing body sections defining an air flow and wiring channel between the housing upper compartment and the housing lower compartment.

19. A lighting fixture for implementing enhanced performance for multiple applications comprising:

a housing formed by a unitary member defining a novel heat management housing; and said housing formed by aluminum extrusion construction;

said housing including a predefined profile and features providing enhanced heat transfer including a housing upper compartment receiving driver components and a housing lower compartment for receiving Light Emitting Diode (LED) lighting modules;

said predefined profile including a stepped profile with said housing upper compartment having an exterior elongated rectangular shape and said housing lower compartment having an exterior elongated upwardly tapered profile, said housing upper compartment having a width substantially less than a width of said housing lower compartment, and an end wall with exterior upwardly tapered profile connects the housing upper compartment and the housing lower compartment;

said housing lower compartment includes predefined features providing enhanced heat transfer, and receiving an upwardly facing lower lens member; and said housing including an interior gap defining an air flow and wiring channel between the housing upper compartment and the housing lower compartment.

* * * * *